US007242781B2

(12) United States Patent
Hou

(10) Patent No.: US 7,242,781 B2
(45) Date of Patent: Jul. 10, 2007

(54) NULL ADAPTATION IN MULTI-MICROPHONE DIRECTIONAL SYSTEM

(75) Inventor: Zezhang Hou, Cupertino, CA (US)

(73) Assignee: Apherma, LLC, Sunnyvale, CA (US)

( * ) Notice: Subject to any disclaimer, the term of this patent is extended or adjusted under 35 U.S.C. 154(b) by 1076 days.

(21) Appl. No.: 09/858,299

(22) Filed: May 15, 2001

(65) Prior Publication Data

US 2001/0028720 A1 Oct. 11, 2001

Related U.S. Application Data

(63) Continuation of application No. 09/788,271, filed on Feb. 16, 2001, now abandoned.

(60) Provisional application No. 60/183,241, filed on Feb. 17, 2000.

(51) Int. Cl.
*H04R 25/00* (2006.01)

(52) U.S. Cl. ..... 381/92; 381/93; 381/318

(58) Field of Classification Search ..... 381/92, 381/71.1, 94.7, 94.1, 91, 122, 111–114, 93, 381/94.8, 121, 312–313, 317–318; 367/119–126
See application file for complete search history.

(56) References Cited

U.S. PATENT DOCUMENTS

| | | | | |
|---|---|---|---|---|
| 3,836,732 | A | 9/1974 | Johanson et al. | |
| 3,975,599 | A | 8/1976 | Johanson | |
| 4,131,760 | A | 12/1978 | Christensen et al. | |
| 4,701,953 | A | 10/1987 | White | |
| 4,712,244 | A | 12/1987 | Zwicker et al. | |
| 4,751,738 | A | 6/1988 | Widrow et al. | |
| 4,956,867 | A | 9/1990 | Zurek et al. | |
| 5,214,709 | A * | 5/1993 | Ribic | 381/313 |
| 5,325,436 | A | 6/1994 | Soli et al. | |
| 5,390,254 | A | 2/1995 | Adelman | |
| 5,434,924 | A | 7/1995 | Jampolsky | |
| 5,479,522 | A | 12/1995 | Lindemann et al. | |
| 5,524,056 | A | 6/1996 | Killion et al. | |
| 5,625,684 | A | 4/1997 | Matouk et al. | |
| 5,737,430 | A | 4/1998 | Widrow | |
| 5,740,256 | A | 4/1998 | Castello Da Costa et al. | |
| 5,757,933 | A | 5/1998 | Preves et al. | |
| 6,539,096 | B1 * | 3/2003 | Sigwanz et al. | 381/313 |
| 6,757,394 | B2 * | 6/2004 | Matsuo | 381/92 |

FOREIGN PATENT DOCUMENTS

| | | |
|---|---|---|
| EP | 569216 A1 | 11/1993 |
| EP | 0856833 A2 | 8/1998 |
| EP | 982971 A2 | 3/2000 |
| EP | 982971 A3 | 3/2000 |
| JP | 63-002500 | 1/1988 |
| JP | 06 269085 | 9/1994 |

(Continued)

OTHER PUBLICATIONS

Glover, "A review of Cardioid Type Unidirectional Microphones", (Jan. 1940) J.A.S.A., vol. 11, pp. 296-302.

(Continued)

*Primary Examiner*—Suhan Ni

(57) ABSTRACT

Improved approaches to adaptively suppress interfering noise in a multi-microphone directional system are disclosed. These approaches operate to adapt the direction null for the multi-microphone directional system in accordance with a dominant noise source.

25 Claims, 9 Drawing Sheets

FOREIGN PATENT DOCUMENTS

| | | |
|---|---|---|
| JP | 11-220796 | 8/1999 |
| WO | WO 99/03091 | 1/1999 |

OTHER PUBLICATIONS

Killion et al., "The case of the missing dots: AI and SNR loss", (May 1998) The Hearing Journal, vol. 51, No. 5, pp. 1-6.
Gravel et al., "Children's Speech Recognition in Noise Using Omni-Directional and Dual-Microphone Hearing Aid Technology", Ear & Hearing, Feb. 1999, pp. 1-11.
Ricketts et al., "Comparison of Performance across Three Directional Hearing Aids", J Am Acad Audiol vol. 10, 1999, pp. 180-189.
Buerkli-Halevy, "The directional microphone advantage", Hearing Instruments, vol. 38, No. 8, 1987.
Preves, "Directional Microphone Use in ITE Hearing Instruments", The Hearing Rev., Jul. 1997, pp. 21-27.
Greenberg et al., "Evaluation of an adaptive beamforming method for hearing aids", J. Acoust. Soc. Am. 91 (3), Mar. 1992, pp. 1662-1676.
Agnew, "How multi-microphone arrays can improve directionality", The Hearing Journal, vol. 50, No. 8, Aug. 1997, pp. 34-46.
Roberts et al., "Measurement and Intelligibility Optimization of Directional Microphones for Use in Hearing Aid Devices", 103rd Convention of Audio Engineering Society (AES), Sep. 1997, 13 pp.
Desloge et al., "Microphone-Array Hearing Aids with Binaural Output—Part I: Fixed-Processing Systems", IEEE Trans. on Speech & Audio Proc., vol. 5, No. 6, Nov. 1997, pp. 529-542.
Welker et al., "Microphone-Array Hearing Aids with Binaural Option—Pant II: A Two-Microphone Adaptive System", IEEE Trans. On Speech & Audio Proc., vol. 5, No. 6, Nov. 1997, pp. 543-551.
Greenberg, "Modified LMS Algorithms for Speech Processing with an Adaptive Noise Canceller", IEEE Trans. On Speech & Audio Proc., vol. 6, No. 4, Jul. 1998, pp. 338-351.
Van Tasell, "New DSP instrument designed to maximize binaural benefits", , The Hearing Journal, vol. 51, No. 4, Apr. 1998, pp. 40-49.
Edwards et al., "New digital processor for hearing loss compensation is based on auditory system", The Hearing Journal, vol. 51, No. 8, Aug. 1998.
Stadler et al., "On the potential of fixed arrays for hearing aids", J. Acoust. Soc. Am. 94 (3), Pt. 1, Sep. 1993, pp. 1332-1342.
Zurek et al., "Prospects and Limitations of Microphone-Array Hearing Aids", World Scientific, Aug. 1995, pp. 233-244.
Killion et al., "Real-world performance of an ITE directional microphone", The Hearing Journal., vol. 51, No. 4, Apr. 1998, pp. 1-6.
Killion, "SNR Loss: 'I Can *Hear* What People Say, But I Can't *Understand* Them'", The Hearing Rev., vol. 4, No. 12, Dec. 1997.
Edwards et al., "Signal-processing algorithms for a new software-based, digital hearing device", The Hearing Journal, vol. 51, No. 9, Sep. 1998.
Killion, "The SIN report: circuits haven't solved the hearing-in-noise problem", The Hearing Journal., vol. 50, No. 10, Oct. 1997, pp. 28-31.
Cadalli et al., "Wideband Maximum Likelihood Direction Finding and Signal Parameter Estimation by Using the Tree-Structured EM Algorithm", IEEE Trans. On Signal Proc., vol. 47, No. 1, Jan. 1999, pp. 201-206.
Souza et al., "Quantifying the Contribution of Audibility to Recognition of compression-Amplified Speech", Ear & Hearing, vol. 20, No. 1, Feb. 1999, pp. 12-20.
microZOOM™, Marketing pamphlet, Phonak, 2 pgs.
Senso: The Single Most Advanced Hearing Instrument Ever Developed, Marketing pamphlet, Widex, 2 pgs.
"HJReport", The Hearing Journal, vol. 50, No. 8, Aug. 1997, pp. 7-8.
International Search Report, PCT/US01/09167, mailed Sep. 17, 2002.
Written Opinion, PCT/US01/09167, mailed Feb. 14, 2002.
International Preliminary Examination Report, PCT/US01/09167, mailed Aug. 5, 2002.

* cited by examiner

NULL ADAPTATION IN MULTI-MICROPHONE DIRECTIONAL SYSTEM

CROSS-REFERENCE TO RELATED APPLICATIONS

This application is a continuation of U.S. application Ser. No. 09/788,271, filed Feb. 16, 2001 now abandoned, and entitled "NULL ADAPTATION IN MULTI-MICROPHONE DIRECTIONAL SYSTEM", which claims the benefit of U.S. Provisional Application No. 60/183,241, filed Feb. 17, 2000, and entitled "METHODS FOR NULL ADAPTATION IN MULTI-MICROPHONE DIRECTIONAL SYSTEM", the contents of both of which are hereby incorporated by reference. This application is also related to (i) U.S. application Ser. No. 09/808,694, filed Mar. 14, 2001, and entitled "ADAPTIVE MICROPHONE MATCHING IN MULTI-MICROPHONE DIRECTIONAL SYSTEM", the contents of which is hereby incorporated by reference; and (ii) U.S. application Ser. No. 09/813,430, filed Mar. 20, 2001, and entitled "AUTOMATIC DIRECTIONAL PROCESSING CONTROL FOR MULTI-MICROPHONE SYSTEM", the contents of which is hereby incorporated by reference.

BACKGROUND OF THE INVENTION

1. Field of the Invention

The present invention relates to noise suppression and, more particularly, to noise suppression for multi-microphone sound pick-up systems.

2. Description of the Related Art

Suppressing interfere noise is still a major challenge for most communication devices involving a sound pick up system such as a microphone or a multi-microphone array. The multi-microphone array can selectively enhance sounds coming from certain directions while suppressing interferes coming from other directions. The pattern of the direction selection can be fixed or adaptive. Adaptive selection is more attractive because it intends to maximize SNR depending on the sound environment. However, because the relative low frequency range of audio applications, existing adaptation techniques are effective only for microphone array with large physical dimension. For applications where physical dimension is limited, such as the case in hearing aid applications, traditional adaptation using Finite-Impulse-Response (FIR) adaptive filtering techniques is not effective. As a result, most hearing aids that have directional processing can only give a fixed directional pattern which is effective in improving Signal-to-Noise Ratio (SNR) in some conditions but less effective in other conditions.

FIG. 1 shows a typical directional processing system in a two-microphone hearing aid. The two microphones pick-up sounds and convert them into electronic or digital signals. The output signal from the second microphone is delayed and subtracted from the output signal of the first microphone. The result is a signal with interference from certain directions being suppressed. In other words, the output signal is dependent on which directions the input signals come from. Therefore, the system is directional. The physical distance between the two microphones and the delay are two variables that control the characteristics of the directionality. For hearing aid applications, the physical distance is limited by the physical dimension of the hearing aid. The delay can be set in a delta-sigma analog-to-digital converter (A/D) or by use of an all-pass filter.

FIGS. 2(*a*)-2(*c*) illustrate polar patterns of a directional processing system corresponding to three different delay values. The term "polar pattern" has often been used to describe the characteristics of a directional processing system. The physical distance between the two microphones of the directional processing system is fixed. When a sound source is at 0 degrees, which is the direction along the axis of the two microphones and on the side of the front microphone, the directional processing system has a maximum output. When the sound source is away from 0 degrees, the output is reduced. The direction at which the output of the directional processing system has a maximum reduction is called directional null. Ideally, the directional null occurs at the direction of an unwanted noise source. The location of the directional null is related to the value of the delay. If the noise source is in the direction of 180 degrees, the delay should be set to a value so that the polar pattern is a cardioids with the directional null at 180 degrees (see FIG. 2(*a*)). If the noise source is in the direction of 115 degrees, the delay should be set to a value so that the polar pattern is a hyper-cardioid with the directional null at 115 degrees (see FIG. 2(*b*)). If the noise source is in the direction of 90 degrees, the delay should be set to a value so that the polar pattern is a bi-directional with the directional null at 90 degrees (see FIG. 2(*c*)). Ideally, the delay should be set in such a way that the null is placed in the direction of the dominant noise source so that the noise can be highly suppressed. If the direction of the noise source is known, the optima delay can be calculated as:

$$\text{delay}=d/c*\cos(180°-q),$$

where d is distance of the two microphones, c is sound propagation speed, and q is direction angle in degree of the noise source.

One problem with conventional noise suppression approaches is that the direction of a noise source to be suppressed by the directional processing is often unknown. Conventionally, the estimating of the direction of a noise source is difficult because the frequency of audio sounds is relative low. The direction of the noise source is often merely a rough estimate from which a delay is then fixed to provide directional processing. In fact, most hearing aids currently available in the market merely set the delay to a fixed value so that directional processing has a fixed polar pattern for all conditions. Unfortunately, the noise suppression of such devices is often inadequate because the noise source is often at a direction other than that corresponding to the fixed delay.

Thus, there is a need for improved approaches to directional processing by adapting a directional null according to the direction of interfering noise source.

SUMMARY OF THE INVENTION

Broadly speaking, the invention relates to improved approaches adaptively suppress interfering noise in a multi-microphone directional system. These approaches operate to adapt the direction null for the multi-microphone directional system. These approaches are particularly useful for hearing aid applications in which directional noise suppression is important.

One aspect of the invention pertains to techniques for adjusting a delay adaptively so that a directional null is placed in the direction of a dominant noise source. This would produce maximum Signal-to-Noise Ratio (SNR) improvement across all conditions. In other words, the dominant noise source is attenuated (e.g., suppressed) but the desired sound from a particular direction is not attenuated The invention can be implemented in numerous ways including as a method, system, apparatus, device, and computer readable medium. Several embodiments of the invention are discussed below.

As an adaptive directional sound processing system, one embodiment of the invention includes at least: a least two microphones spaced apart by a predetermined distance, each of said microphones producing an electronic sound signal; a delay circuit that delays the electronic sound signal from at least one of said microphones by an adaptive delay amount; a subtraction circuit operatively connected to said microphones and said delay circuit, said subtraction circuit producing an output difference signal from the electronic sound signals following said delay circuit; and a delay amount determination circuit operatively coupled to receive the output difference signal, said delay amount determination circuit produces a delay control signal that is supplied to said delay circuit so as to control the adaptive delay amount.

As an adaptive directional sound processing system, another embodiment of the invention includes at least: a least two microphones spaced apart by a predetermined distance, each of said microphones producing an electronic sound signal; a delay circuit that delays the electronic sound signal from at least one of said microphones by an adaptive delay amount; a logic circuit operatively connected to said microphones and said delay circuit, said logic circuit producing an output signal from the electronic sound signals following said delay circuit; and a delay amount determination circuit operatively coupled to receive the output signal, said delay amount determination circuit produces a delay control signal based on the output signal, the delay control signal being is supplied to said delay circuit so as to control the adaptive delay amount.

As an adaptive directional sound processing system, another embodiment of the invention includes at least: at least two microphones spaced apart by a predetermined distance, each of said microphones producing an electronic sound signal; a delay circuit that delays the electronic sound signal from at least one of said microphones by an adaptive delay amount; logic means for producing an output signal from the electronic sound signals following said delay circuit; and delay determination means for producing a delay control signal based on the output signal, the delay control signal being is supplied to said delay circuit so as to control the adaptive delay amount.

As a method for adaptively controlling delay induced on a sound signal so that unwanted noise is directionally suppressed, one embodiment of the invention includes at least the acts of: producing a difference signal from at least first and second sound signals respectively obtained by first and second microphones; estimating an energy amount of the difference signal; and producing a delay signal to control a delay amount induced on at least one of the first and second sound signals based on the energy amount of the difference signal.

As an adaptive delay method for directional noise suppression in a hearing aid device, the hearing aid device having at least first and second microphones, one embodiment of the invention includes at least the acts of: receiving first and second microphone outputs; delaying at least the second microphone output by an adaptive delay amount; combining the first microphone output and the delayed second microphone output to produce an output signal; estimating an energy amount associated with the output signal; and adapting the adaptive delay amount based on the energy amount.

As a method for adaptively controlling delay induced on a sound signal in a multi-microphone directional processing system so that unwanted noise is directionally suppressed, another embodiment of the invention includes at least the acts of: receiving at least first and second sound signals respectively obtained by first and second microphones; delaying at least one of the first and second sound signals by a plurality of different delay amounts; producing, following the delaying act, a plurality difference signals from at least first and second sound signals respectively obtained by first and second microphones; estimating energy amounts for each of the difference signals; and choosing the one of the difference signals as an output of the directional processing system based on the energy amounts of the difference signals.

As an adaptive directional sound processing system, another embodiment of the invention includes at least: at least two microphones spaced apart by a predetermined distance, each of the microphones producing an electronic sound signal; a plurality of delay circuits that each delay the electronic sound signal from at least one of the microphones by a different delay amount; logic means for producing candidate output signals from the electronic sound signals following the delay circuits; and output selection means for selecting one of the candidate output signals as an output based on energy levels of the candidate output signals.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention relates to improved approaches adaptively suppress interfering noise in a multi-microphone directional system. These approaches operate to adjust a direction null for the multi-microphone directional system.

One aspect of the invention pertains to techniques for adjusting a delay adaptively so that a directional null is placed in the direction of a dominant noise source. This would produce maximum Signal-to-Noise Ratio (SNR) improvement across all conditions. In other words, a dominant noise source is attenuated (e.g., suppressed) but the desired sound from a particular direction is not attenuated Consequently, the invention enables multi-microphone directional processing systems to adaptively suppress a noise source. The invention is described below with respect to embodiments particularly well suited for use with hearing aid applications. However, it should be recognized that the invention is not limited to hearing aid applications, but is applicable to other sound pick-up systems.

Embodiments of this aspect of the invention are discussed below with reference to FIGS. 3-9. However, those skilled in the art will readily appreciate that the detailed description given herein with respect to these figures is for explanatory purposes as the invention extends beyond these limited embodiments.

Figure 1:
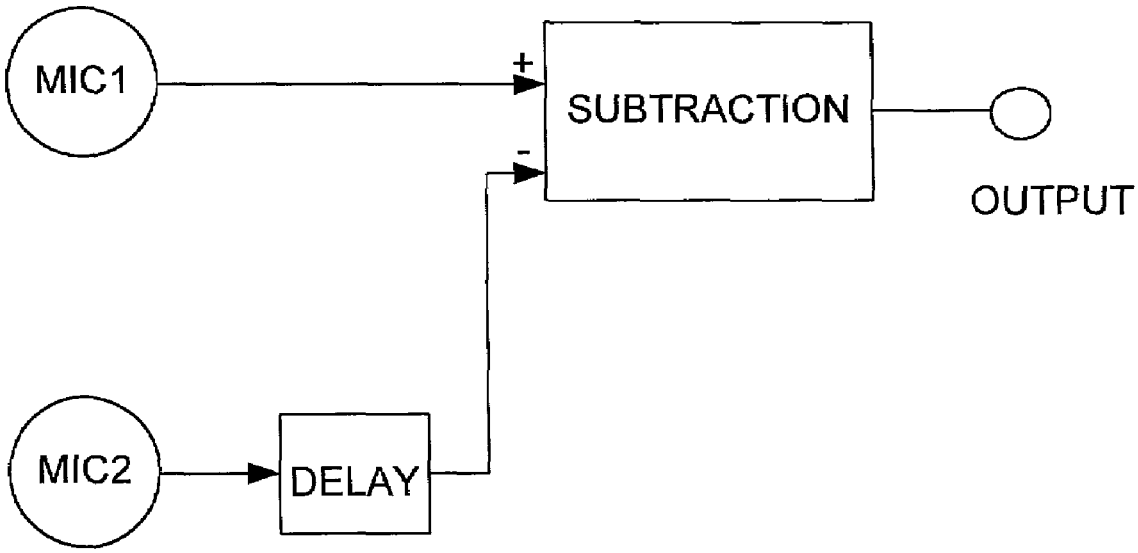
FIG. 1 (Prior Art)
FIG. 1 shows a typical directional processing system in a two-microphone hearing aid.
Figure 2A:
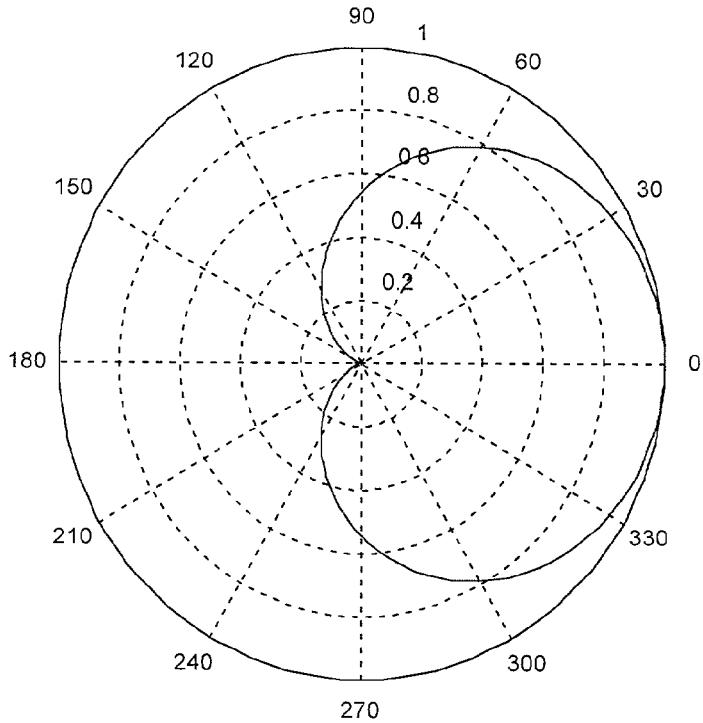
FIGS. 2(*a*)-2(*c*) illustrate polar patterns of a directional processing system corresponding to three different delay values.
Figure 2B:
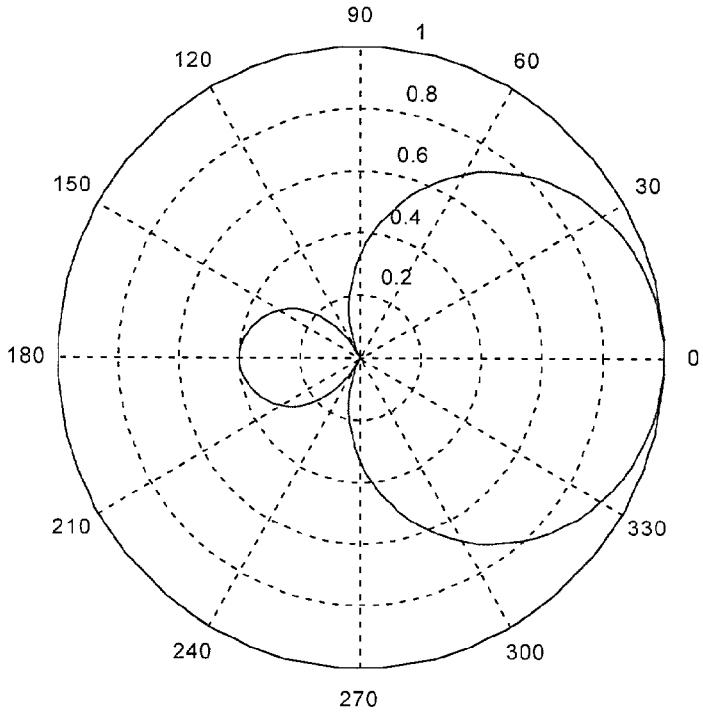
Figure 2C:
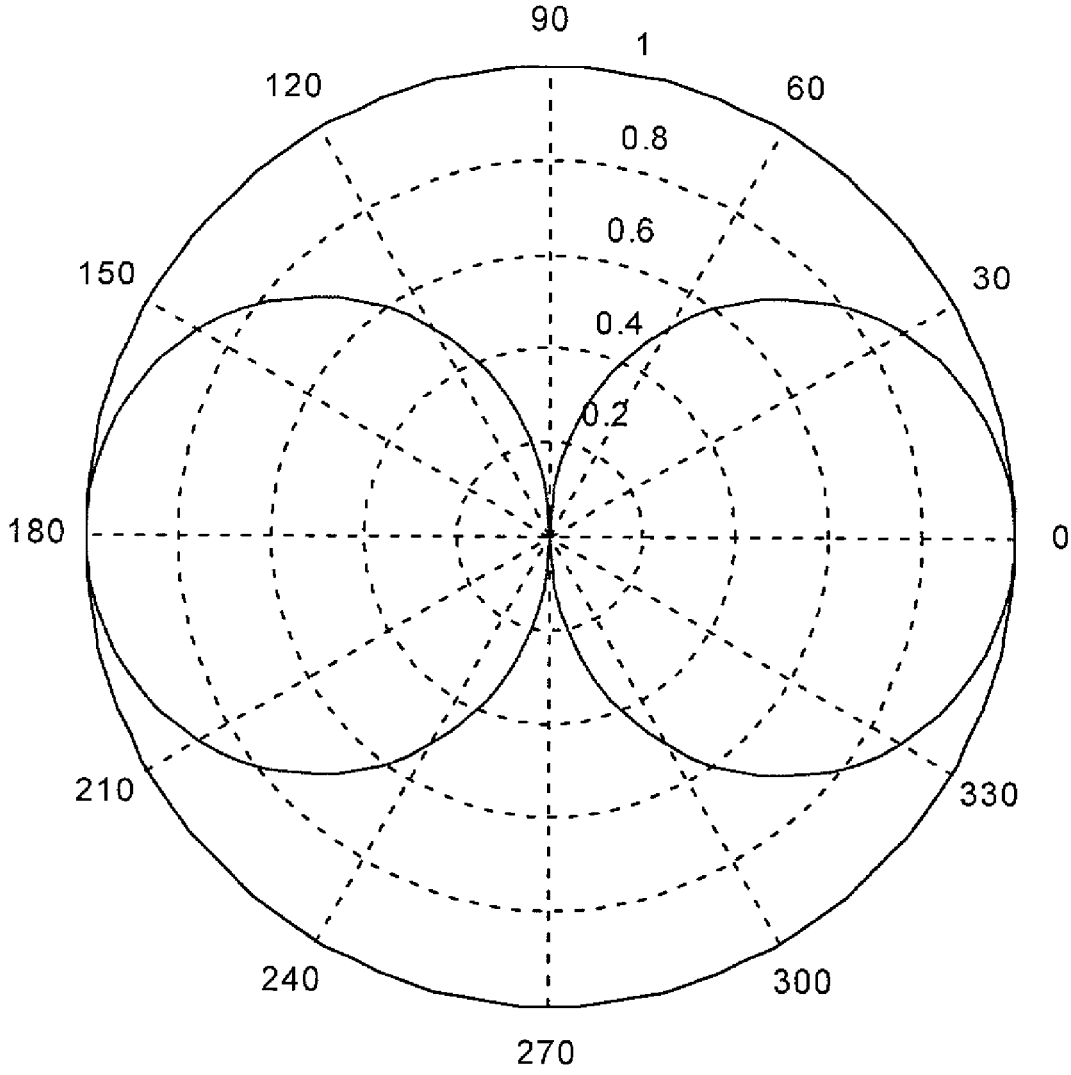
Figure 3:
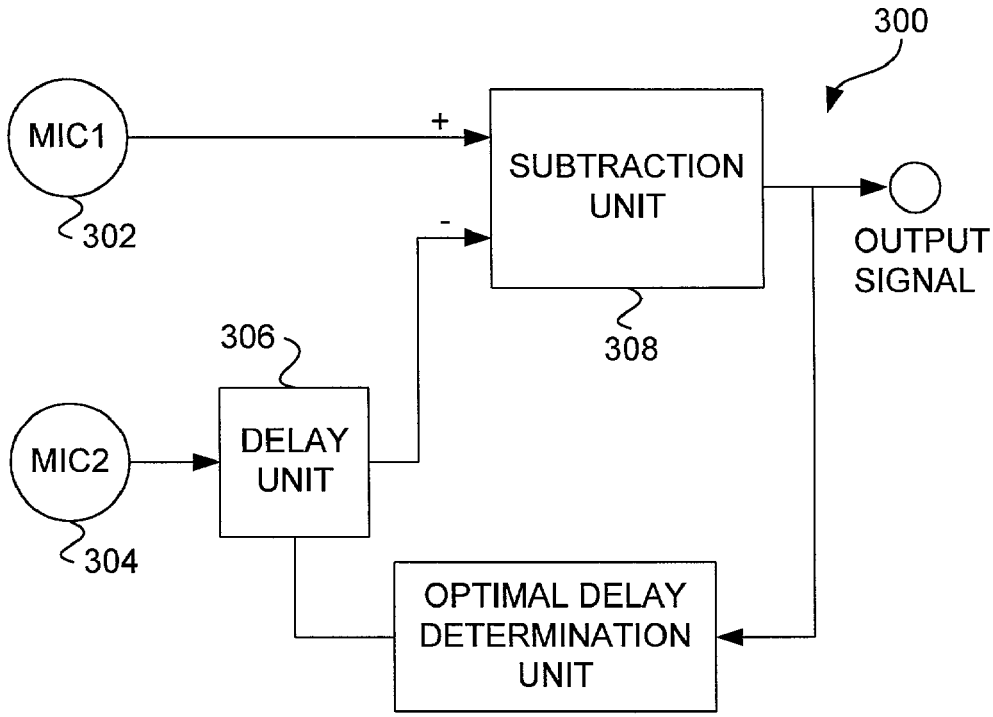
FIG. 3 is a block diagram of a two-microphone directional processing system according to one embodiment of the invention.

FIG. 3 is a block diagram of a two-microphone directional processing system 300 according to one embodiment of the invention. The two-microphone directional processing system 300 includes a first microphone 302 and a second microphone 304. The first microphone 302 produces a first electronic sound signal, and the second microphone 304 produces a second electronic sound signal. The first and second electronic sound signals can be either analog or digital signals. In one implementation, the first and second microphones 302 and 304 are physically spaced by a distance of at least 3 mm. A delay unit 306 delays the second electronic sound signal by a delay amount. A subtraction unit 308 then subtracts the delayed second electronic sound signal from the first electronic sound signal to produce an output signal. At this point, the output signal has undergone directional processing by the two-microphone directional processing system 300. Such directional processing enables unwanted interference from certain directions to be suppressed.

The two-microphone directional processing system 300 also includes an optimal delay determination unit 310. The output signal produced by the substation unit 308 is supplied to the optimal delay determination unit 310. The optimal delay determination unit 310 determines a delay amount (e.g., optimal delay) that the delay unit 306 should induce on the second electronic sound signal so that the directional null associated with the directional processing occurs at the direction of a noise source. The delay amount, or a corresponding control signal, is supplied to the delay unit 306 where the delay is imposed. Hence, the optimal delay determination unit 310 causes the delay amount for the delay unit 306 to self-adjust based on the output energy (e.g., output signal) of the two-microphone directional processing system 300. In other words, the delay induced by the delay unit 306 automatically adjusts based on the output energy.

When interfering noise is present, the total energy of the signals picked up by the microphones 302 and 304 are greater than the output energy would be if the interfering noise were not present. According to one embodiment, the delay amount for the delay unit 306 can be adjusted so that the output of the two-microphone directional processing system 300 has minimum energy. Because change in the delay amount does not change the system response to desired sound coming from 0 degrees, minimizing the output energy by adjusting the delay is equivalent to achieving a maximum attenuation of noise (assuming the desired sound is coming from 0 degrees).

The output signal of the directional processing system 300 can be further processed by other processing functions. In the case of hearing aid applications, the output of the directional processing is further processed by other hearing aid functions such as amplification and noise suppression.

Figure 4:
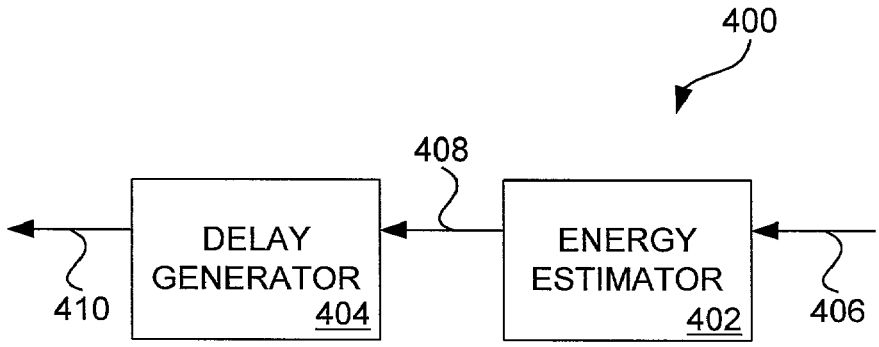
FIG. 4 shows a block diagram of an optimal delay determination unit according to one embodiment of the invention.

FIG. 4 shows a block diagram of an optimal delay determination unit 400 according to one embodiment of the invention. The optimal delay determination unit 400 is, for example, suitable for use as the optimal delay determination unit 400. The optimal delay determination unit 400 includes an energy estimator 402 and a delay generator 404. The energy estimator 402 receives a feedback signal 406. The feedback signal 406 is the output signal produced by the directional processing system 300. The energy estimator 402 receives the feedback signal 406 and creates an energy signal 408. The delay generator 404 receives the energy signal 408 and generates a delay signal 410 (delay amount; control signal) based on the energy signal 408. More particularly, the delay generator 404 controls the delay amount induced by the delay unit 306 in such a way that the output energy is statistically minimized and, therefore, the Signal-to-Noise Ratio (SNR) is maximized.

The energy estimator 402 can create the energy signal 408 by any one of the following: (1) forcing its input into positive signal; (2) squaring the input; (3) calculating a Root-Mean-Square (RMS) signal for the input; or (4) estimating a minimum signal from the input. The energy signal 408 can be down-sampled first before being used to generate the delay signal 410.

The delay generator 404 produces the delay signal 410 based on the energy signal 408. In one embodiment, the delay signal 410 is a delay amount obtained by determining a change in the energy signal, creating a delay increment signal in accordance with the change, and adding the delay increment signal to a current delay amount to produce a next delay amount.

It should be noted that the optimal delay determination unit 400 can also utilize a down sampling process between the energy estimator 402 and the delay generator 404 as typically the energy estimate from the energy estimator 402 will have a higher sampling rate than that of the delay generator 404. The result is that the output of the energy estimator 402 changes fast while the output from the delay generator 404 changes slowly. For example, in one embodiment, the input to and output from the energy estimator 402 can be digital signals at a higher sampling rate, e.g., 16 kHz, while the input to and output from the delay generator 404 can be digital signals at a lower sampling rate (e.g., 1 kHz). A down sampling process can thus be provided between the energy estimator 402 and the delay generator 404 to accommodate the difference in sampling rates. Down sampling is a term frequently used in digital signal processing to describe a process that reduces the sampling frequency from high to low.

Alternatively, instead of reducing the sampling frequency through down sampling, a similar effect can be achieved by using a slower time constant in the delay generator 404 than that of the energy estimator 402. Time constant describes how fast the output of a processing block changes with its input. Here, the time constant for the delay generator 404 can be slower than the time constant of the energy estimator 402 so that the output of the energy estimator 402 changes fast while the output from the delay generator 404 changes slowly.

Figure 5A:
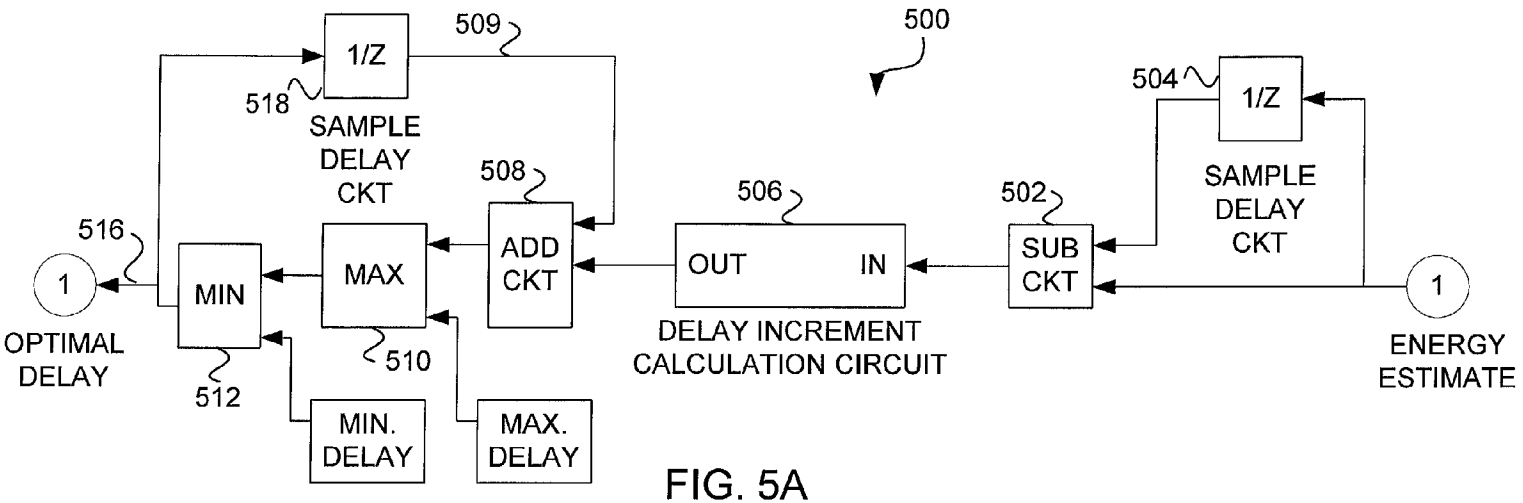
FIG. 5A is a block diagram of a delay generator according to one embodiment of the invention.

FIG. 5A is a block diagram of a delay generator 500 according to one embodiment of the invention. The delay generator 500 is, for example, suitable for use as the delay generator 404 illustrated in FIG. 4. The delay generator 500 includes a subtraction circuit 502. The subtraction circuit 502 receives the energy signal 408 from the energy estimator 402. A sample delay circuit 504 delays the energy signal 408 by a specified amount (e.g., 1/z) before supplying the delayed energy signal to the subtraction circuit 502. The subtraction circuit 502 subtracts the energy signal 408 from the delayed energy signal to produce an energy change signal. The energy change signal is supplied to a delay increment calculation circuit 506.

The delay increment calculation circuit 506 calculates a current delay increment based on the energy change signal. The current delay increment is then supplied to an add circuit 508. The add circuit 508 adds the current delay increment to a previous delay increment 509 to output an unrestricted optimal delay. The unrestricted optimal delay is then supplied to a maximum delay circuit 510 and a minimum delay circuit 512. The unrestricted optimal delay, after passing through the maximum delay circuit 510 and the minimum delay circuit 512, outputs an optimal delay 516. The maximum delay circuit 510 limits the upper range for the optimal delay to a maximum value, and the minimum delay circuit 512 limits the minimum delay to a minimum value. Although the limits will vary widely with application, in one embodiment, the maximum value can be 36 and the minimum value can be zero. The optimal delay 516 is also fed back through a sample delay circuit 518 which produces the previous delay increment 509 that is supplied to the add circuit 508. The optimal delay 516 is, for example, the delay signal 410 illustrated in FIG. 4.

The circuitry for the delay increment calculation circuit 506 can take many forms. FIGS. 5A, 5B and 5C illustrate three of many different approaches to calculate or determine the current delay increment.

FIG. 5B is a schematic diagram of a circuit 520 suitable for use as the delay increment calculation circuit 506 according to one embodiment of the invention. The circuit 520 calculates the current delay increment from the energy change signal. The circuit 520 includes a switch circuit 522, a negate circuit 524, and a sample delay circuit 526. The energy change signal is supplied to a control terminal of the switch circuit 522 to control its switching. The switch circuit 522 outputs the delay increment signal. The delay increment signal is also fed back to the sample delay circuit 526 which produces a previous delay increment signal. The previous delay increment signal is supplied to the negate circuit 514 as well as to a first switch terminal of the switch circuit 522. The negate circuit 524 inverts the previous delay increment signal and supplies the inverted previous delay increment signal to a second switch terminal of the switch circuit 522.

The switch circuit 522 is controlled in accordance with the energy difference signal. When the switch circuit 522 determines that the energy difference signal is greater than zero (0), then the delay increment signal being output by the circuit 520 corresponds to the previous delay increment signal. Alternatively, when the switch circuit 522 determines that the energy difference signal is less than zero (0), then the delay increment signal being output by the circuit 520 corresponds to the inverted previous delay increment. Hence, when the energy difference signal is greater than zero (0), the delay increment signal remains the same as it previously was. On the other hand, when the energy difference signal is less than zero (0), then the delay increment signal is negated from its previous value. As an example, the energy difference signal and the delay increment being output can be represented in multiple bits, such as 16 bits, of either integer or floating point numerical storage.

FIG. 5C is a schematic diagram of a circuit 540 suitable for use as the delay increment calculation circuit 506 according to another embodiment of the invention. The circuit 540 calculates the current delay increment from the energy change signal. The circuit 540 includes a multiply circuit 542 and a sample delay circuit 544. The energy difference signal is received at the multiply circuit 542. In addition, the multiply circuit 542 receives a previous delay increment signal from the sample delay circuit 544. Here, the multiply circuit 542 multiplies the energy difference signal with the previous delay increment signal to produce the delay increment signal. The delay increment signal is also supplied to the sample delay circuit 544 which delays the signal by a specified amount (1/z) to produce the previous delay increment signal.

Figure 5D:
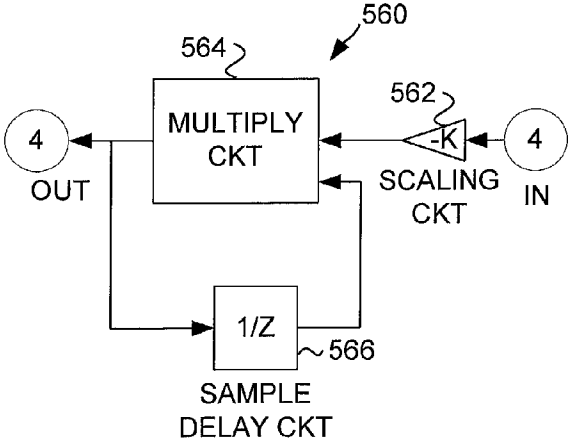
FIG. 5D is a schematic diagram of a circuit suitable for use as the delay increment calculation circuit according to still another embodiment of the invention.
Figure 5C:
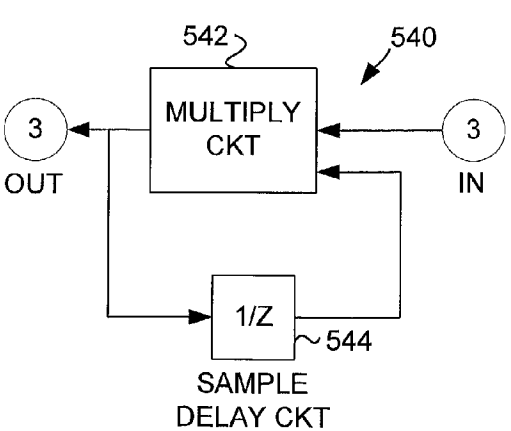
FIG. 5C is a schematic diagram of a circuit suitable for use as a delay increment calculation circuit according to another embodiment of the invention.
Figure 5B:
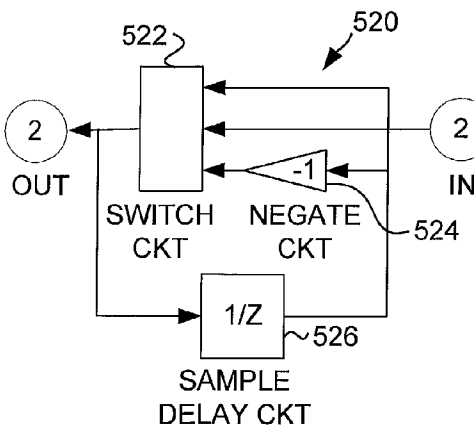
FIG. 5B is a schematic diagram of a circuit suitable for use as a delay increment calculation circuit according to one embodiment of the invention.

FIG. 5D is a schematic diagram of a circuit 560 suitable for use as the delay increment calculation circuit 506 according to still another embodiment of the invention. The circuit 560 calculates the current delay increment from the energy change signal. The circuit 560 includes a scaling circuit 562, a multiply circuit 564, and a sample delay circuit 566. The energy difference signal is supplied to the scaling circuit 562 that scales the energy difference signal in accordance with a parameter K. Here, in one embodiment, the scaling parameter K is negative (−K). The scaled energy difference signal is then supplied to the multiply circuit 564. The multiply circuit 564 also receives a previous delay increment signal produced by the sample delay circuit 566. The multiply circuit 564 multiplies the previous delay increment signal by the scaled energy difference signal to produce the delay increment signal. The delay increment signal is also supplied to the sample delay circuit 5664 which delays the signal by a specified amount (1/z) to produce the previous delay increment signal.

Figure 6:
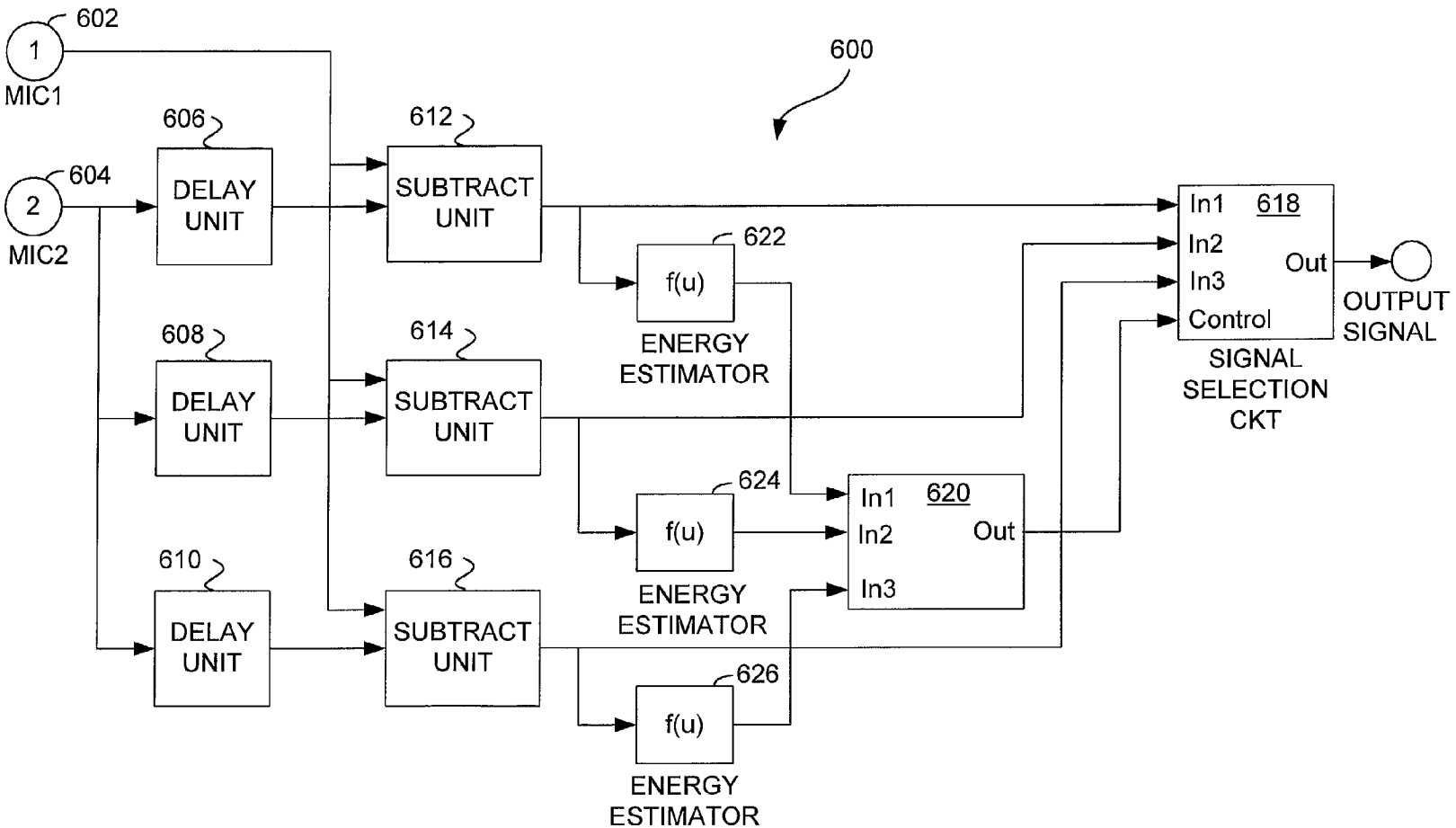
FIG. 6 shows an alternative method for adapting the direction null to maximize SNR in a two-microphone directional processing system.

FIG. 6 is a block diagram of a two-microphone directional processing system 600 according to another embodiment of the invention. The two-microphone directional processing system 600 includes a first microphone 602 and a second microphone 604. The first microphone 602 produces a first electronic sound signal, and the second microphone 604 produces a second electronic sound signal. The first and second electronic sound signals can be either analog or digital signals.

The directional processing system 600 also includes a series of different delay units 606, 608 and 610. Each of these delay units 606, 608 and 610 operate to induce different delays to the second electronic sound signal. In addition, the directional processing system 600 also includes subtract circuits 612, 614 and 616. Each of the subtract circuits 612, 614 and 616 receives the first electronic sound signal from the first microphone 604. In addition, the subtract circuit 614 receives the delayed second electronic sound signal from the delay unit 606. The subtract circuit 614 receives the delayed second electronic sound signal from the delay unit 608. The subtract circuit 616 receives the delayed second electronic sound signal from the delay unit 610. Each of the subtract circuits 612, 614 and 616 produce a difference signal. The difference signals produced by the subtract circuits 612, 614 and 616 are each supplied to a signal selection circuit 618. Under the control of a control signal, the signal selection circuit 618 outputs one of the difference signals as the output signal. At this point, the output signal has undergone directional processing by the directional processing system 600. Such directional processing enables unwanted interference from certain directions to be suppressed.

The control signal to the signal selection circuit 618 is provided by a selector 620 together with energy estimators 622, 624 and 626. The energy estimator 622 estimates the energy on the difference signal produced by the subtract circuit 612, and supplies the energy estimate to a first input to the selector 620. The energy estimator 624 estimates the energy on the difference signal produced by the subtract circuit 614, and supplies the energy estimate as a second input to the selector 620. The energy estimator 626 estimates the energy of the difference signal produced by the subtract circuit 616 and supplies the energy estimate to a third input to the selector 620. The selector 620 then selects one of the estimated energy values supplied by the energy estimators 622, 624 and 626 as the selected output which forms the control signal that controls the signal selection circuit 618.

The directional processing system 600 selects the difference signal that has the lowest energy as the system output (output signal). The lowest energy means that the channel or path undergoing the most noise suppression is selected. The different delay units 606, 608 and 610 together with the subtract units 612, 614 and 616 for the channels or paths. In this embodiment, the delays for the delay elements are fixed and thus do not adapt. Instead, the various delay units offer different delays and the channel or path providing the best noise suppression is chosen. Although the directional processing system 600 provided only three channels or paths, it should be recognized that additional paths can be provided. In general, the directional processing system 600 operates with two or some channels or paths.

The signal energy can be estimated in a variety of ways. For example, the energy signal can be estimated using one of the followings: (1) forcing its input into positive signal; (2) squaring the input; (3) calculating a Root-Mean-Square (RMS) signal for the input; or (4) estimating a minimum signal from the input. Also, it should be noted that the rate at which the energy signal is estimated need not be the same as the rate in which the delay signal is updated. In other words, the energy signal can be updated with a different time constant that a time constant used in updating the delay signal. For example, for a fixed sampling rate, the energy signal can be updated for every sample, while the delay signal can be updated every 100 samples.

The adaptive directional processing system includes at least two microphones, typically physically spaced by a distance of at least three (3) mm. The microphones are used to convert sound into electronic signals. The electronic signals can be either analog or digital. The system further includes delay means to delay the electronic signals from one or both microphones. The system further includes addition or subtraction means to generate a differential signal of the microphone outputs as delayed by the delay means. The system also includes means for estimating the energy of the differential signal. The delay from the delay means is used to adapt the directional null to suppress a dominant noise source. The delay means, the addition/subtraction means, and the energy estimate means can be used more than once in parallel so that multiple delayed signals, multiple differential signals, and multiple energy signals are created.

Although the above-described embodiments of the directional processing systems have utilized two microphones, it should be understood that the directional processing systems can also use more than two microphones. Furthermore, following directional processing, the output of the directional processing system can be further processed by other processing functions. In the case of hearing aid applications, the output of the directional processing is further processed by other hearing aid functions such as amplification and noise suppression.

Figure 7:
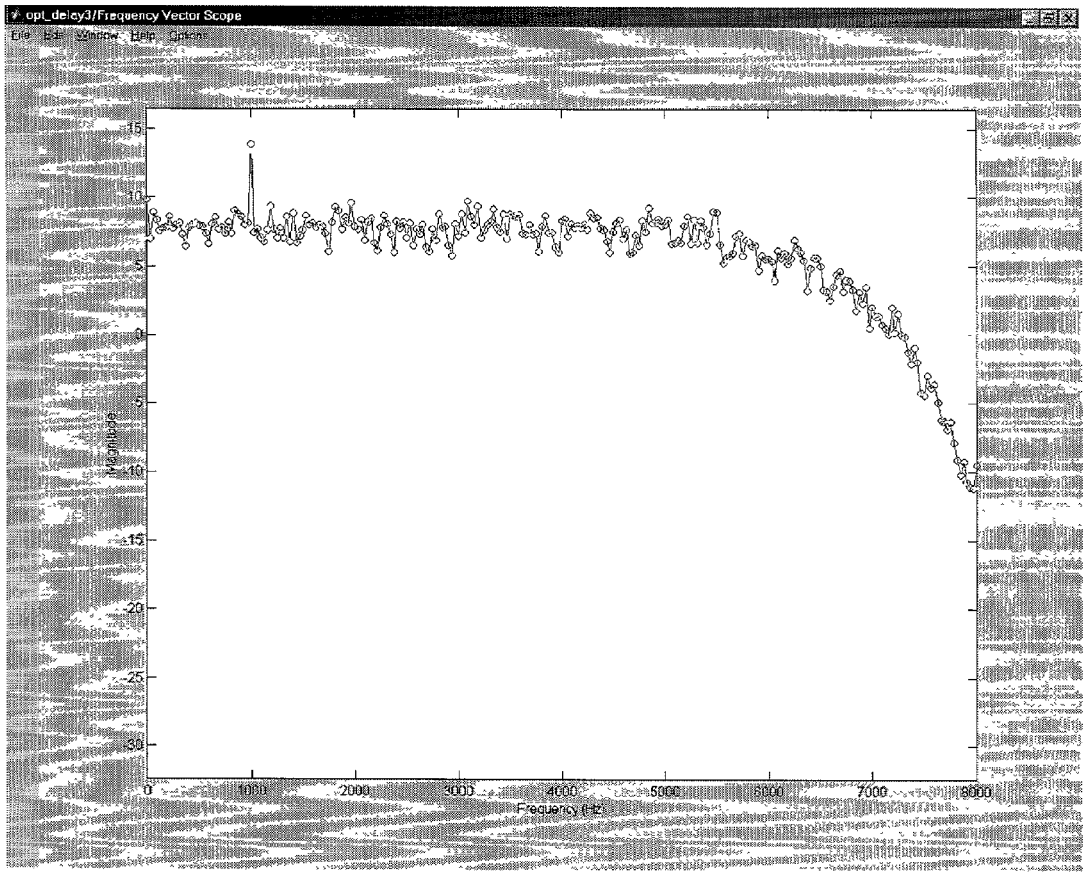
FIG. 7 is a graph illustrating a spectrum of a 1 kHz pure tone in white noise without any directional processing for noise reduction.

FIG. 7 is a graph illustrating a spectrum of a 1 kHz pure tone in white noise without any directional processing for noise reduction. The SNR of the spectrum is about 6 dB.

Figure 8:
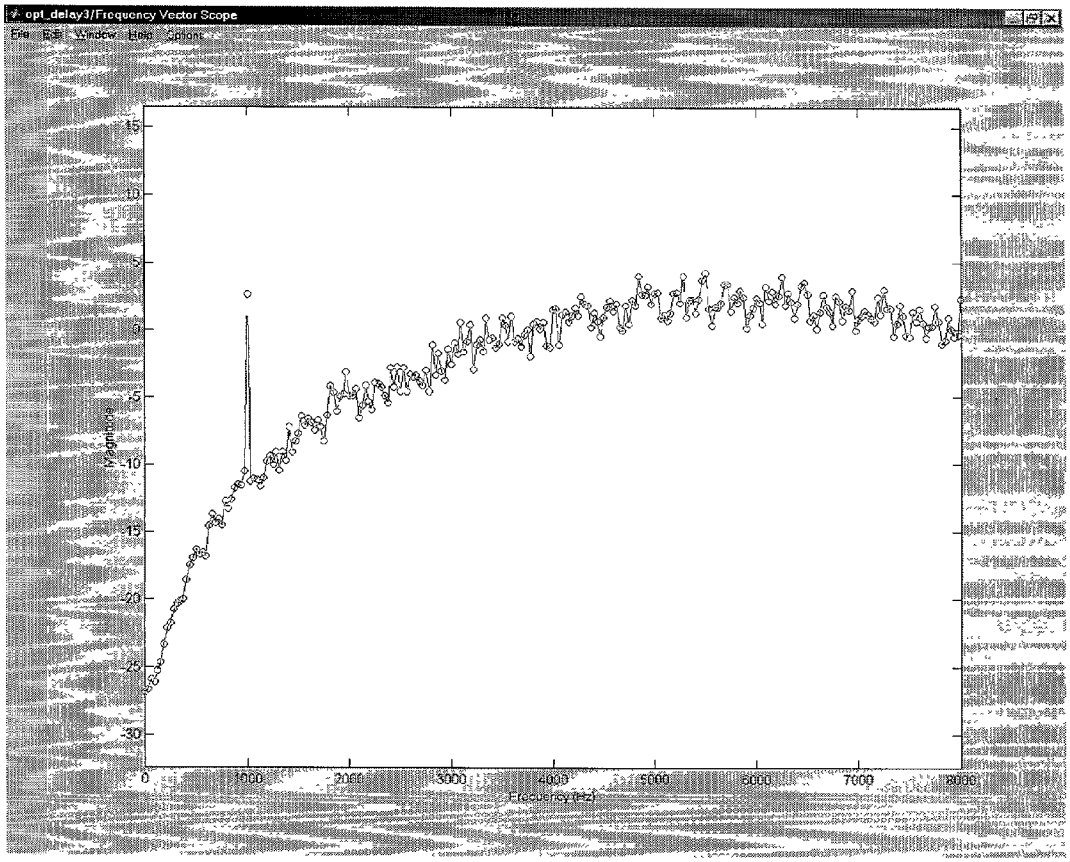
FIG. 8 is a graph illustrating a spectrum of a 1 kHz pure tone in white noise with fixed-pattern (hypercaidiod) directional processing for noise reduction.

FIG. 8 is a graph illustrating a spectrum of a 1 kHz pure tone in white noise with fixed-pattern (hypercaidiod) directional processing for noise reduction. The SNR of the spectrum is about 14 dB.

Figure 9:
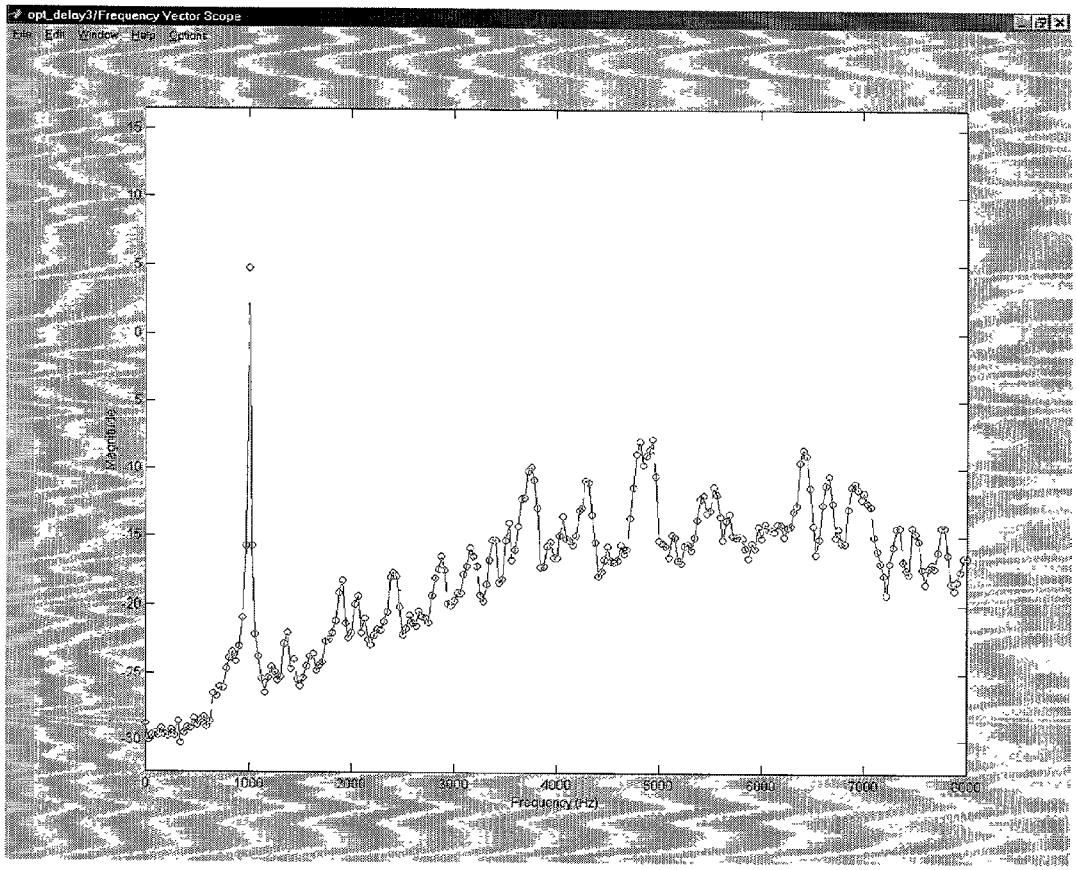
FIG. 9 is a graph illustrating a spectrum of a 1 kHz pure tone in white noise with adaptive directional processing according to one embodiment of the invention to provide enhanced noise reduction.

FIG. 9 is a graph illustrating a spectrum of a 1 kHz pure tone in white noise with adaptive directional processing according to one embodiment of the invention to provide enhanced noise reduction. The SNR of the spectrum is about 30 dB, which is a dramatic improvement over the conventionally available SNRs associated with FIGS. 7 and 8.

The invention is preferably implemented in hardware, but can be implemented in software or a combination of hardware and software. The invention can also be embodied as computer readable code on a computer readable medium. The computer readable medium is any data storage device that can store data which can be thereafter be read by a computer system. Examples of the computer readable medium include read-only memory, random-access memory, CD-ROMs, magnetic tape, optical data storage devices, carrier waves. The computer readable medium can also be distributed over a network coupled computer systems so that the computer readable code is stored and executed in a distributed fashion.

The advantages of the invention are numerous. Different embodiments or implementations may yield one or more of the following advantages. One advantage of the invention is that a dominant noise source can be directionally suppressed. Another advantage of the invention is that the directional suppression is adaptive and thus changes as the directional of the dominant noise source changes. Still another advantage of the invention is that desired sound from a particular direction is not interfered with even though a dominant noise source is able to be directionally suppressed.

The many features and advantages of the present invention are apparent from the written description and, thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. An adaptive directional sound processing system, comprising:

a least two microphones spaced apart by a predetermined distance, each of said microphones producing an electronic sound signal;

a delay circuit that delays the electronic sound signal from at least one of said microphones by an adaptive delay amount;

a subtraction circuit operatively connected to said microphones and said delay circuit, said subtraction circuit producing an output difference signal from the electronic sound signals following said delay circuit; and a delay amount determination circuit operatively coupled to receive the output difference signal, said delay amount determination circuit produces a delay control signal that is supplied to said delay circuit so as to control the adaptive delay amount, wherein said adaptive directional sound processing system resides within a personal hearing aid device adapted for use within or proximate to a user's ear, and wherein the adaptive delay amount induced by said delay circuit operates to minimize the energy amount of the output difference signal while not significantly attenuating sound arriving at said microphones from a predetermined direction.

2. An adaptive directional sound processing system as recited in claim 1, wherein the adaptive delay amount varies so as to directionally suppress undesired sound.

3. An adaptive directional sound processing system as recited in claim 1, wherein said adapting operates to minimize the energy amount of the output difference signal so as to maximize Signal-to-Noise Ratio (SNR).

4. An adaptive directional sound processing system, comprising:

first and second microphones spaced apart by a predetermined distance, each of said first and second microphones producing an electronic sound signal;

a delay circuit that delays the electronic sound signal from said second microphone by an adaptive delay amount;

a logic circuit operatively connected to said microphones and said delay circuit, said logic circuit producing an output signal from a difference from the electronic sound signal from said first microphone and the electronic sound signal from said second microphone after being adaptively delayed by said delay circuit; and a delay amount determination circuit operatively coupled to receive the output signal, said delay amount determination circuit produces a delay control signal based on the output signal, the delay control signal being supplied to said delay circuit so as to control the adaptive delay amount, wherein the adaptive delay amount varies so as to directionally suppress undesired sound, wherein said adaptive directional sound processing system resides within a personal hearing aid device adapted for use within or proximate to a user's ear, and wherein the adaptive delay amount induced by said delay circuit operates to minimize the energy amount of the output signal while not significantly attenuating sound arriving at said microphones from a predetermined direction.

5. An adaptive directional sound processing system as recited in claim 4, wherein said adapting operates to minimize the energy amount of the output signal so as to maximize Signal-to-Noise Ratio (SNR).

6. An adaptive directional sound processing system as recited in claim 4, wherein the adaptive delay amount induced by said delay circuit is controlled such that a delay increment is added to a previously determined adaptive delay amount.

7. An adaptive directional sound processing system as recited in claim 6, wherein the delay increment is determined based on change in energy on the output signal.

8. An adaptive directional sound processing system as recited in claim 6, wherein the change in energy selects one of two possible delay increments.

9. An adaptive directional sound processing system as recited in claim 8, wherein the two possible delay increments are a previous delay increment and an inverse previous delay increment.

10. An adaptive directional sound processing system as recited in claim 6, wherein the delay increment is determined by multiplying a previous delay increment by a change in energy on the output signal.

11. An adaptive directional sound processing system as recited in claim 6, wherein the delay increment is determined by scaling a change in energy on the output signal and then multiplying a previous delay increment by the change in energy on the output signal.

12. An adaptive directional sound processing system, comprising:

first and second microphones spaced apart by a predetermined distance, each of said first and second microphones producing an electronic sound signal;

a delay circuit that delays the electronic sound signal from said second microphone by an adaptive delay amount;

a logic circuit operatively connected to said microphones and said delay circuit, said logic circuit producing an output signal from a difference from the electronic sound signal from said first microphone and the electronic sound signal from said second microphone after being adaptively delayed by said delay circuit; and a delay amount determination circuit operatively coupled to receive the output signal, said delay amount determination circuit produces a delay control signal based on the output signal, the delay control signal being supplied to said delay circuit so as to control the adaptive delay amount, wherein the adaptive delay amount varies so as to directionally suppress undesired sound, wherein said adaptive directional sound processing system resides within a personal hearing aid device adapted for use within or proximate to a user's ear, wherein said delay amount determination circuit comprises:

an energy estimator that receives the output signal and produces an energy estimate signal; and a delay generator that receives the energy estimate signal and generates a delay signal based on the energy estimate signal.

13. An adaptive directional sound processing system as recited in claim 12, wherein said energy estimator operates at a first sampling rate and said delay generator operates at a second sampling rate, the first sampling rate being greater than the second sampling rate, and wherein down sampling is performed between said energy estimator and said delay generator to accommodate difference in the first and second sampling rates.

14. An adaptive directional sound processing system as recited in claim 12, wherein said energy estimator uses a first time constant and said delay generator uses a second time constant, the first time constant being faster that the second time constant.

15. An adaptive directional sound processing system, comprising:

first and second microphones spaced apart by a predetermined distance, each of said first and second microphones producing an electronic sound signal;

a delay circuit that delays the electronic sound signal from said second microphone by an adaptive delay amount;

logic means for producing an output signal from a difference from the electronic sound signal from said first microphone and the electronic sound signals signal from said second microphone after being adaptively delayed by said delay circuit; and a delay determination circuit for producing a delay control signal based on the output signal, the delay control signal being supplied to said delay circuit so as to control the adaptive delay amount, wherein the adaptive delay amount varies so as to directionally suppress undesired sound, wherein said adaptive directional sound processing system resides within a personal hearing aid device adapted for use within or proximate to a user's ear, wherein said delay determination circuit comprises:

an energy estimator that receives the output signal and produces an energy estimate signal; and a delay generator that receives the energy estimate signal and generates a delay signal based on the energy estimate signal.

16. In an electronic device providing adaptive directional sound processing system, a method for adaptively controlling delay induced on a sound signal so that unwanted noise is directionally suppressed, said method comprising:

(a) producing a difference signal from at least first and second sound signals respectively obtained by first and second microphones;

(b) estimating an energy amount of the difference signal;

(c) producing a delay signal to control a delay amount induced on at least one of the first and second sound signals based on the energy amount of the difference signal;

(d) inducing the delay amount on at least one of the first and second sound signals; and (e) repeating said operations (a)-(d) so that the delay amount is dynamically adjusted so as to directionally suppress the unwanted noise, wherein the adaptive directional sound processing system resides within a personal hearing aid device adapted for use within or proximate to a user's ear, and wherein the dynamically adjusted delay amount being induced operates to minimize the energy amount of the difference signal while not significantly attenuating sound arriving at the microphones from a predetermined direction.

17. An adaptive delay method for directional noise suppression in a hearing aid device, the hearing aid device having at least first and second microphones, said method comprising:

receiving first and second microphone outputs;

delaying at least the second microphone output by an adaptive delay amount;

combining the first microphone output and the delayed second microphone output to produce an output signal;

estimating an energy amount associated with the output signal; and adapting the adaptive delay amount based on the energy amount, wherein the adaptive delay amount varies so as to directionally suppress undesired noise, wherein the hearing aid device is adapted for use within or proximate to a user's ear, wherein said adapting determines the adaptive delay amount based on change in energy on the output signal, wherein the change in energy on the output signal selects one of two possible delay increments, and wherein the two possible delay increments are a previous delay increment and an inverse previous delay increment.

18. A method as recited in claim 17, wherein said adapting operates to minimize the energy amount of the output signal while not significantly attenuating sound arriving at the first and second microphones from a predetermined direction.

19. A method as recited in claim 17, wherein said adapting operates to minimize the energy amount of the output signal so as to maximize Signal-to-Noise Ratio (SNR).

20. A method as recited in claim 17, wherein said combining comprises adding the first microphone output and the delayed second microphone output.

21. A method as recited in claim 17, wherein said combining comprises subtracting the first microphone output and the delayed second microphone output.

22. An adaptive delay method for directional noise suppression in a hearing aid device, the hearing aid device having at least first and second microphones, said method comprising:

receiving first and second microphone outputs;

delaying at least the second microphone output by an adaptive delay amount;

combining the first microphone output and the delayed second microphone output to produce an output signal;

estimating an energy amount associated with the output signal; and adapting the adaptive delay amount based on the energy amount, wherein the adaptive delay amount varies so as to directionally suppress undesired noise, wherein the hearing aid device is adapted for use within or proximate to a user's ear, and wherein said adapting of the adaptive delay amount comprises multiplying a previous delay increment by a change in energy on the output signal.

23. A method as recited in claim 22, wherein said adapting of the adaptive delay amount further comprises scaling a change in energy on the output signal prior to the multiplying the previous delay increment by the change in energy on the output signal.

24. A method for adaptively controlling delay induced on a sound signal in a multi-microphone directional processing system so that unwanted noise is directionally suppressed, said method comprising:

(a) receiving at least first and second sound signals respectively obtained by first and second microphones;

(b) concurrently delaying one of the first and second sound signals by a plurality of different delay amounts;

(c) producing, following said delaying (b), a plurality difference signals from at least first and second sound signals respectively obtained by first and second microphones;

(d) estimating energy amounts for each of the difference signals; and (e) choosing the one of the difference signals as an output of the directional processing system based on the energy amounts of the difference signals, wherein the choosing (e) of the one of the difference signals as an output of the directional processing system is performed by minimizing the energy amount of the output difference signal while not significantly attenuating sound arriving at the first and second microphones from a predetermined direction.

25. A method as recited in claim 24, wherein the sound signals are provided by a hearing aid, and wherein said method is performed by the hearing aid.

* * * * *